US008157117B2

(12) United States Patent
Grampassi

(10) Patent No.: US 8,157,117 B2
(45) Date of Patent: Apr. 17, 2012

(54) LOCKING MECHANISM FOR THE COVER FOR A DRINK DISPENSING MACHINE

(75) Inventor: Massimo Grampassi, Castelvetro (IT)

(73) Assignee: SPM Drink Systems S.R.L., Spilamberto (MO) (IT)

( * ) Notice: Subject to any disclaimer, the term of this patent is extended or adjusted under 35 U.S.C. 154(b) by 967 days.

(21) Appl. No.: 12/010,460

(22) Filed: Jan. 25, 2008

(65) Prior Publication Data

US 2008/0185385 A1 Aug. 7, 2008

(30) Foreign Application Priority Data

Jan. 25, 2007 (IT) ..... MO07A0020

(51) Int. Cl.
*B65D 45/16* (2006.01)

(52) U.S. Cl. ..... 220/326; 220/315; 220/262; 292/165; 292/169

(58) Field of Classification Search ..... 220/314, 220/324, 326, 262; 292/159, 169, 165
See application file for complete search history.

(56) References Cited

U.S. PATENT DOCUMENTS

| | | | | | |
|---|---|---|---|---|---|
| 140,307 | A | * | 6/1873 | Rand | 292/36 |
| 1,428,945 | A | * | 9/1922 | Denne | 220/592.18 |
| 1,749,337 | A | * | 3/1930 | Geyer | 220/592.18 |
| 2,363,567 | A | | 11/1944 | Blakeman | |
| 2,786,606 | A | | 3/1957 | Dushek | |
| 2,936,189 | A | * | 5/1960 | Pearson | 292/42 |
| 3,315,850 | A | * | 4/1967 | Gran | 222/501 |
| 3,915,341 | A | | 10/1975 | Brown | |
| 3,953,061 | A | * | 4/1976 | Hansen et al. | 292/5 |
| 4,015,454 | A | * | 4/1977 | Struble | 70/2 |
| D259,232 | S | * | 5/1981 | Tarozzi | D7/313 |
| 5,016,926 | A | * | 5/1991 | Sharp et al. | 292/42 |
| 5,261,550 | A | * | 11/1993 | Karpisek | 220/4.33 |
| D349,417 | S | * | 8/1994 | Malmborg et al. | D7/306 |
| 5,470,115 | A | * | 11/1995 | Berg et al. | 292/335 |

(Continued)

FOREIGN PATENT DOCUMENTS

EP 1 431 239 6/2004

*Primary Examiner* — Anthony Stashick
*Assistant Examiner* — Christopher McKinley
(74) *Attorney, Agent, or Firm* — Stein McEwen, LLP

(57) ABSTRACT

A tank for receiving a drink to be dispensed, the tank is rectangular in shape and opens upwardly, a discharge valve is located at the lower, front end of the tank, and a cover fits over the open end of the tank. Detents are formed at the upper end of the walls of the tank. A manually operable locking mechanism secures the cover in fixed position atop the tank. The locking mechanism comprises a vertical shaft or axle that extends through the central part of the cover. A knob is secured to the upper end of the shaft, and a cam is secured to the lower end of the shaft. A plurality of elongated rods pass through diametrically opposed slots in a housing secured to the underside, or interior, of the cover. One end of each rod has a contact surface which is urged against the perimeter of the cam, while the opposite end of the is a locking surface. When the knob is rotated in one direction, the locking surfaces of the rods are forced into the detents to lock the cover in fixed position. When the cam is rotated in the opposite direction, compression springs retract the rods from the apertures, to allow the removal of the cover from the open end of the tank.

7 Claims, 3 Drawing Sheets

U.S. PATENT DOCUMENTS

| | | | | |
|---|---|---|---|---|
| D366,387 | S * | 1/1996 | Malmborg et al. | D7/313 |
| 5,499,850 | A * | 3/1996 | Sharp | 292/42 |
| 6,086,121 | A * | 7/2000 | Buckland | 292/34 |
| 6,350,418 | B1 | 2/2002 | Venderpool | |
| 6,783,162 | B1 * | 8/2004 | Harper | 292/40 |
| 7,108,135 | B2 * | 9/2006 | Park | 206/711 |
| 7,118,483 | B2 * | 10/2006 | Beadell et al. | 463/46 |
| 7,708,160 | B2 * | 5/2010 | Booth et al. | 220/4.28 |
| 7,775,564 | B2 * | 8/2010 | Moore | 292/37 |
| 2006/0163263 | A1 * | 7/2006 | Helline | 220/592.18 |

* cited by examiner

LOCKING MECHANISM FOR THE COVER FOR A DRINK DISPENSING MACHINE

BACKGROUND OF THE INVENTION

The present invention pertains to a locking mechanism for securing a cover to the open, upper end of a tank operatively associated with a known drink dispensing machine for preparing, and dispensing, hot, cold, or iced drinks.

SUMMARY OF THE INVENTION

The use of drink dispensing machines is well known in public premises, such as ice-cream parlors, bars, cafes or restaurants, or public premises in general. The machines dispense cold drinks, such as sodas, fruit juices, water or drinks in general, or iced drinks such as crushed-ice drinks, sorbets, etc.

These dispensing machines generally comprise a base housing conventional operating bodies for the machine, and support a containing tank for the drink to be dispensed, or as an alternative, one of the components to be mixed before dispensing same. In dispensing machines for dispensing cold or iced drinks, the base can house a cooling system associated with the tank and suitable for keeping the drink inside the tank at a predetermined temperature and/or consistency. Stirrer means with blades or the like can be provided inside the tank; such blades are driven by motor means arranged in the base of the drink dispensing machine and are suitable for keeping the drink in motion to adjust its fluidity and to prevent the separation of the components of different specific weights within the tank.

The tank generally includes an upper opening for introducing the drink and at least one dispensing outlet with a suitable collection and dosing tap, or a discharge valve, for discharging the drink itself. A cover is positioned on the tank to close the upper opening. However, when the cover is removed or dislodged, the risk of contamination of the drink in the tank occurs. To overcome this problem, machines for preparing and dispensing drinks usually employ a cover locking system at the upper opening of the tank. Such locking systems, to date, have been relatively costly to manufacture, and unduly complex to operate successfully.

The need for an inexpensive, yet easily operable and effective locking mechanism, for securing the cover in fixed position on the tank to seal same, is realized by applicant's invention. Detents, such as apertures, are formed in the walls of the tank in proximity to the upper end of the tank. The locking mechanism includes as actuator with a shaft that extends vertically above the cover, and is rotatable relative thereto. An eccentric body, or cam, is secured to the lower end of the shaft within the interior of the cover. Rods are movable in slots within a housing secured to the underside, or interior of the cover. The rods are horizontally movable, and slide within the housing. Springs bias the inner ends, or contact surfaces, of the rods against the cam. When the actuator is manually rotated in one direction, the cam rotates and the rods, which are spring loaded against the surface of the cam, are driven outwardly to engage, or fit within, the detents to lock the cover atop the tank. When the actuator is rotated in the opposite direction, the rods are withdrawn inwardly from the detents to release the cover.

Other advantages achieved by applicant's unique locking mechanism will become readily apparent to the skilled artisan from an inspection of the attached drawings and careful review of the detailed specification.

DETAILED DESCRIPTION OF THE INVENTION

Figure 1:
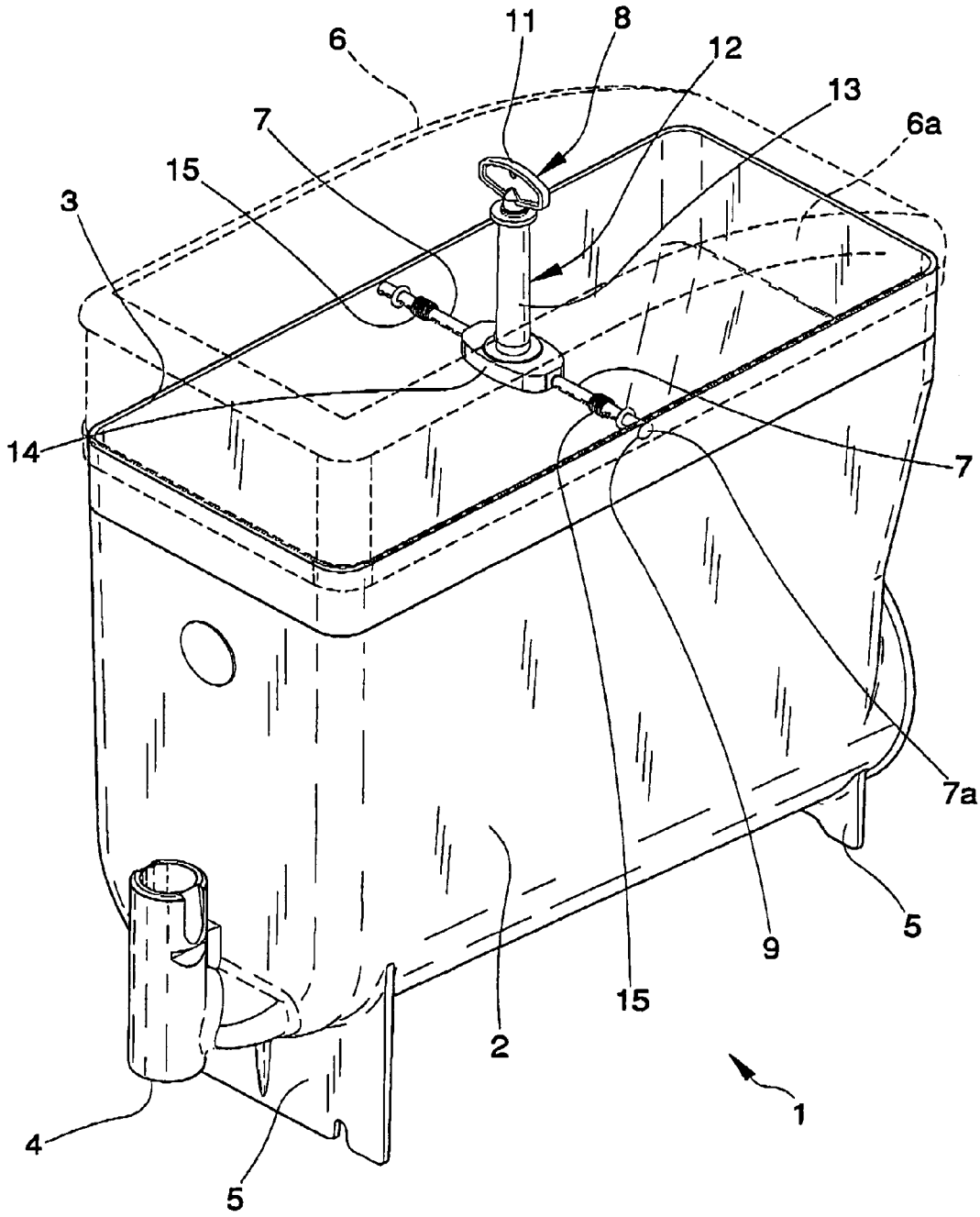
FIG. 1 is a perspective view of a tank adapted to be associated with a drink dispensing machine, a cover seated upon the upper end of the tank, and a manually operable locking mechanism for securing the cover in fixed condition atop the tank.

Referring now to the drawings, reference numeral 1 generally designates a container for a drink dispensing machine capable of discharging hot, cold, or iced drink. Drink dispensing machines are commonly used in ice cream parlors, restaurants, convenience stores, bars, cafes, and on public premises in general. Container 1 comprises tank 2 generally rectangular in shape, which opens upwardly to form inlet 3, and further comprises discharge valve 4. Tank 2 can be fastened on top of the base of a known dispensing machine by virtue of depending legs 5; the legs interlock with special seats defined on the upper portion of the base of a dispensing machine (not shown). The base may house a refrigeration unit, whereby the evaporator draws heat away from tank 2, and maintains the drink in tank 2 at a suitable temperature. Furthermore, rotating stirrers (now shown) may be employed within tank 2 to circulate the drink within the tank and maintain the desired consistency and taste.

The open, upper end, or inlet 3 of tank 2 has a substantially rectangular cross-section. However, inlet 3 may assume other shapes. Discharge valve 4 is located close to the bottom of tank 2, on the front vertical wall of tank 2.

Cover 6 is shaped to conform to, and fit snugly over, inlet 3, of tank 2. A unique locking mechanism is provided to secure cover 6 in fixed position to prevent inadvertent removal. Consequently, the contents of tank 2 are not disturbed and/or subject to contamination, and the sanitary condition of the drink is preserved.

Figure 2:
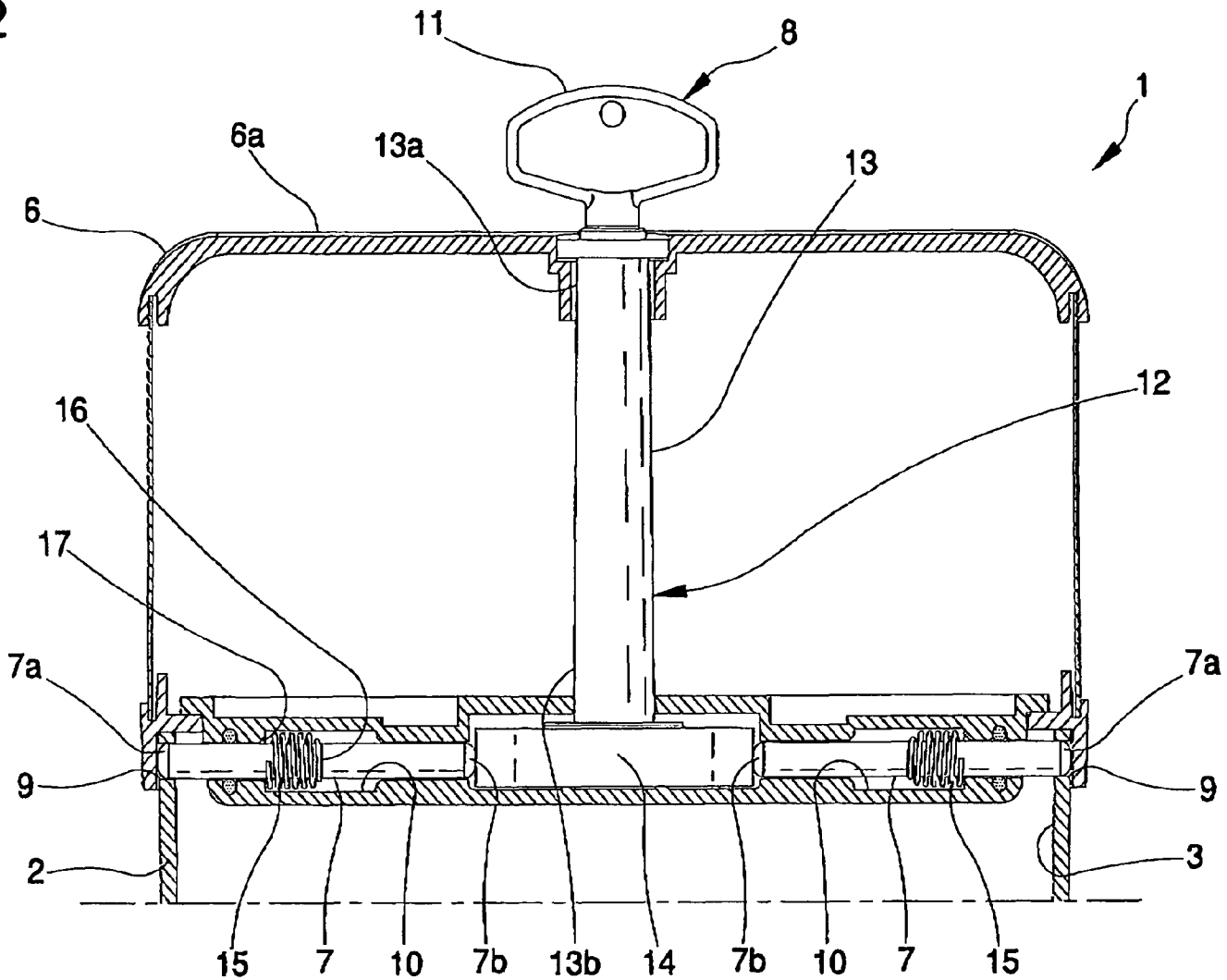
FIG. 2 is a vertical cross sectional view through the cover, showing the locking mechanism in locked position engaging detents in the walls of the tank; only the upper end of the tank is shown.
Figure 3:
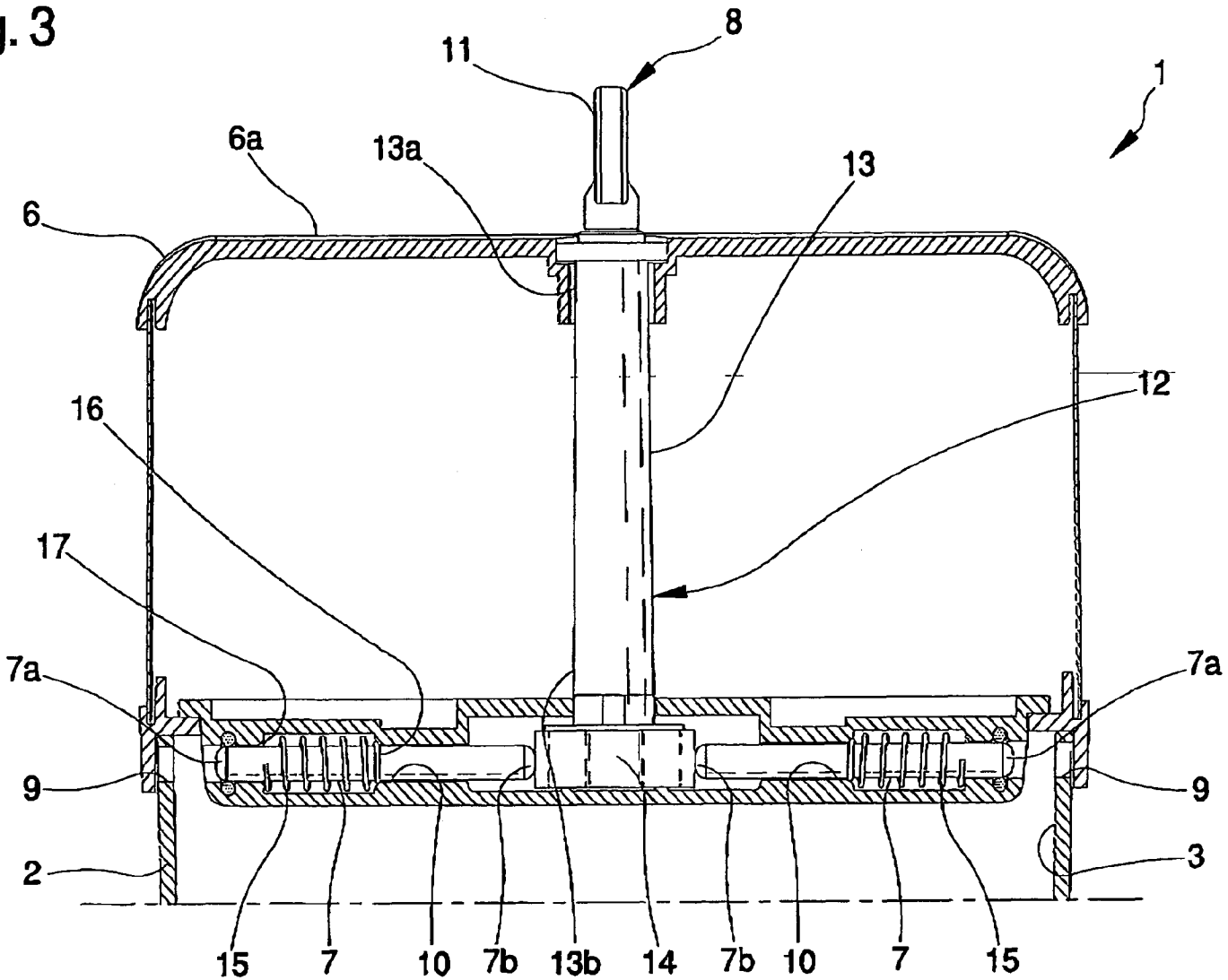
FIG. 3 is a vertical cross sectional view similar to FIG. 2, but showing the locking mechanism in retracted, or unlocked position.

The locking mechanism comprises a pair of stop elements, or rods 7 of elongated shape. Rods 7 are located in a housing secured to the underside of cover 6, as shown in FIGS. 2 and 3. The rods are movable axially between two positions, an extended or locked position as shown in FIG. 2, and a retracted or unlocked position as shown in FIG. 3.

Each rod 7 includes a locking end 7*a* and a contact end 7*b*. Rods 7 are slidable axially within slots 10 in the housing on the underside of cover 6, and respond to the manual operation of actuator 8. Detents, or apertures, 9 are formed in the side walls of tank 2, in proximity to inlet 3, and contact end 7*b* of each rod fits into a detent 9, when the rod is moved to the locking position. The rods fit snugly within slots 10; the slots are enlarged, in their mid-section, for a reason to be discussed subsequently.

Actuator 8 comprises a gripping element, or knob 11, which can be manually rotated relative to cover 6, and mechanism 12 for converting the rotary movement of knob 11 into an axial force for moving stop elements 7. The knob may be planar for easy gripping, and protrudes above upper wall 6*a* of cover 6 at the central portion thereof. Mechanism 12 includes vertically extending rotatable shaft 13. The upper end of shaft 13 is identified by reference numeral 13*a*, while the lower end of the shaft is identified by reference numeral 13*b*. Cam 14 is secured to the lower end 13*b* of shaft 13 in horizontal alignment with rods 7. Several contact surfaces are defined on the perimeter of the cam, and the inner, or connection, end 7*a* of each rod presses against the contact surfaces on cam 14. Rods 7 are arranged in a substantially horizontal plane so the respective connection ends 7*b* engage the perimeter of cam 14 under the urging of biasing members 15. In this specific case, the biasing members 15 assume the form of helical compression springs located around the mid-section of each of the rods 7. Each spring 15 has one end that abuts a first locator 16 on rod 7, and a second end that abuts against second locator 17 defined in the slot in the housing 10.

First locator 16 is made up of an annular groove on a substantially median section of each rod 7, where a terminal section of the respective spring 15 is fitted. Each of the springs 15 extends from the median section of rod 7 to the locking end 7*a*, and the second locator 17 comprises a protrusion or shoulder situated at a narrowing of the slot 10.

Cam 14 has a substantially elliptical profile and rods 7 are substantially coaxial with cam 14 and extend longitudinally, or horizontally, from the diametrically opposite portions of the housing for the rods. Consequently, in the locking position, cam 14 is arranged with its longer axis aligned with the longitudinal axis of rods 7, so that the locking ends 7*a* of rods 7 are fitted in the respective detents 9. In this configuration the springs 15 attain maximum compression.

Detents 9 are through holes suitable for receiving the locking ends 7*a* of the rods 7, when the rods are in the locking position. The holes 9 are arranged in the upper ends of the walls that mark the boundary of the inlet, or mouth, 3.

In the retracted position, shown in FIG. 3, cam 14, which may be elliptical in shape or may assume other shapes, is arranged with the shorter axis aligned with the longitudinal axis of the stop elements 7 so that the locking ends of rods 7 are withdrawn from engagement with detents 9. In this position, the cover 6 can be removed from the tank 2 and an operator can pour in a drink or one of the components to be mixed, through the mouth or opening 3 of tank 2.

The removal of the cover 6, also, allows the operator to carry out maintenance or cleaning operations inside the tank 2.

Once the drink has been poured in, the cover 6 can be positioned atop inlet 3, and locked in sealing position by rotating actuator 8. Turning element 11 causes the rotation of the eccentric body or cam 14, until the longer axis of the eccentric body 14 is aligned with the longitudinal axis of the rods 7. During this rotation, the rods 7 translate, in opposition to the springs 15, until they reach the closing position, with the locking ends 7*a* fitted in the respective detents 9 on the tank 2. The special elliptical shape of the eccentric body, coupled with the diametrically opposite arrangement of the two rods 7, coordinates the simultaneous engagement, and disengagement, of the locking ends 7*a*, of all rods 7, with respect to the corresponding detents 9.

The container 1 can be modular in construction so that a series of tanks can be used for a single machine for producing, and dispensing different flavors, of drinks.

In addition, the container 1, and in particular the tank 2, can be made of transparent materials, such as glass or food-grade plastic, to allow the visual inspection of the contents of tank 2. During use, the container 1 is operatively associated with a machine for preparing and dispensing warm, cold or iced drinks and, in particular, is supported by the base of the machine containing the conventional operating bodies.

Different shapes of the eccentric body 14 are feasible, and the number of the rods 7 can be increased. A possible solution contemplates, for example, the use of four rods 7 associated with a suitably shaped eccentric body 14; the eccentric body 14 is configured to permit four rods 7 to engage detents 9 defined on each of the four sides of the rectangular profile of inlet or mouth 3 of tank 2.

It has in actual fact been found that described invention achieves its objectives, and in particular the fact is underscored that the particular shape of the stop elements and the special actuator arrangement mentioned above permits locking the cover on the tank containing the drink in by a simple and rational solution, easy and practical to use, as well as of low cost.

The invention thus conceived is susceptible of numerous modifications and variations, all of which fall within the scope of the inventive concept. Thus the appended claims should not be limited to their literal terms, but should be construed in a liberal manner consistent with the spirit and scope of applicant's inventive efforts.

What is claimed is:

1. A locking mechanism for use with the cover of a tank for a drink dispensing machine, said mechanism comprising, in combination, a) a tank comprising front, rear and side walls, a bottom connecting said walls, and an open upper end adapted to receive a supply of a drink to be dispensed, b) a discharge valve formed in one of said walls to dispense the drink in measured quantities, c) detents formed in the upper ends of opposing walls, d) a removable cover extending over said open upper end of said tank, e) a housing situated on the underside of said cover, f) opposing slots defined is said housing, g) a locking mechanism located within said housing for securing the cover to said tank to block access to the interior of said tank, h) said locking mechanism including at least a pair of axially movable rods disposed in a horizontal plane and moveable within said slots in said housing, i) each rod having a locking surface on its outer end and a contact surface on its inner end, j) an actuator including a vertically oriented axle extending through said cover, k) a cam with contact surfaces secured to the lower end of said vertically oriented axle and located within said housing intermediate said contact surfaces of said pair of moveable rods, l) a spring encircling each rod to bias the contact surface on each rod against said contact surfaces of said cam, m) whereby manual rotation of said actuator shifts said rods in a horizontal plane so that said locking ends of said rods fit into said detents and lock said cover in a fixed position upon said tank.

2. The locking mechanism of claim 1 wherein one end of said spring is retained in position by a locator on said rod, and the other end of said spring is retained in position by a shoulder defined within each slot, said spring being compressed by the axial movement of said rod relative to said shoulder to retain the locking surface on each rod within each detent.

3. The locking mechanism of claim 1 wherein each spring is a coil spring extending between a first locator on the rod and a second locator in each slot in said housing.

4. The locking mechanism of claim 3 wherein said first locator is an annular groove on the median section of the rod, and said second locator is a shoulder defined within each slot.

5. The locking mechanism of claim 1 wherein each slot is enlarged, at its central portion, to receive one of said springs that fits over each rod to bias the contact end of each rod against the contact surfaces on said cam, said cam being elliptical in shape.

6. The locking mechanism of claim 1 wherein a gripping element at the upper end of said axle, to facilitate rotation of said actuator.

7. The locking mechanism of claim 1 wherein said detents consist of apertures extending through said walls of said tank.

* * * * *